US007966947B2

(12) United States Patent
Roleder

(10) Patent No.: US 7,966,947 B2
(45) Date of Patent: Jun. 28, 2011

(54) RESTING DEVICE ASSEMBLY INCLUDING A TABLE AND A TROLLEY

(75) Inventor: Jon W. Roleder, San Diego, CA (US)

(73) Assignee: Earthlite Massage Tables, Inc., Vista, CA (US)

( * ) Notice: Subject to any disclaimer, the term of this patent is extended or adjusted under 35 U.S.C. 154(b) by 291 days.

(21) Appl. No.: 12/118,501

(22) Filed: May 9, 2008

(65) Prior Publication Data

US 2008/0276838 A1 Nov. 13, 2008

Related U.S. Application Data

(60) Provisional application No. 60/928,764, filed on May 11, 2007.

(51) Int. Cl.
*A47F 5/12* (2006.01)

(52) U.S. Cl. ..... 108/3; 297/188.01; 297/423.41; 312/209; 312/194

(58) Field of Classification Search ..... 297/354.13, 297/188.09, 188.1, 423.41, 423.44, 317, 297/321, 340, 188.11, 188.12; 108/25, 26, 108/11, 12, 17, 3; 5/617, 611, 600; 312/194, 312/196, 209
See application file for complete search history.

(56) References Cited

U.S. PATENT DOCUMENTS 488,649 A * 12/1892 Daggett ..... 5/617
542,060 A * 7/1895 Lentz ..... 312/209
654,922 A * 7/1900 Schipkowsky ..... 312/196
2,118,620 A 5/1938 Orsenigo
2,727,799 A 12/1955 Keal
2,971,568 A * 2/1961 Rorie et al. ..... 297/188.09
3,049,724 A 8/1962 Goodman
3,587,482 A * 6/1971 Wieland ..... 108/147
3,820,176 A * 6/1974 Feiertag ..... 108/147
4,148,264 A 4/1979 Caravias
4,194,452 A 3/1980 Crowther et al.
4,898,103 A 2/1990 Pontoppidan et al.
5,085,447 A 2/1992 Audibert
(Continued)

OTHER PUBLICATIONS

Search Report with Written Opinion for PCT/US2007/012941, publication date Jul. 3, 2008, Earthlite Massage Tables Inc.

*Primary Examiner* — José V Chen
(74) *Attorney, Agent, or Firm* — Roeder & Broder LLP

(57) ABSTRACT

A resting device assembly for supporting a person above a surface during a procedure includes a resting device and a trolley. The resting device includes a device top assembly having a padded device top that supports the person during the procedure, and a device frame that supports the device top assembly. The device frame includes a frame base, a frame leg assembly having a plurality of spaced apart legs that supports the frame base and the device top assembly above the surface, and a height adjuster that adjusts the length of the plurality of spaced apart legs so as to raise and lower the device top relative to the surface. The frame base is a substantially rigid frame base that significantly increases the overall strength, support, and stability of the resting device assembly. The trolley defines a storage area for storing procedure materials that are usable during the procedure. The trolley is movable relative to the resting device between a storage position, wherein the trolley is positioned substantially beneath the resting device, and a working position, wherein the trolley is positioned next to the resting device. When the trolley is in the working position the procedure materials are easily accessed from the trolley.

22 Claims, 7 Drawing Sheets

U.S. PATENT DOCUMENTS 5,323,695 A * 6/1994 Borgman et al. ..... 108/147
5,375,514 A 12/1994 Dann, Jr.
5,410,971 A 5/1995 Golden et al.
5,503,086 A 4/1996 Hoffman et al.
5,562,049 A 10/1996 Hoffman et al.
5,597,199 A * 1/1997 Hoffman et al. ..... 297/188.1
5,687,435 A 11/1997 Dufresne
6,003,450 A 12/1999 Bruckner et al.
6,174,026 B1 1/2001 Wise
6,227,592 B1 5/2001 Thacker
6,343,556 B1 * 2/2002 Lanphear ..... 108/147
6,352,037 B1 * 3/2002 Doyle ..... 108/147
6,666,490 B1 12/2003 Thacker
6,926,160 B2 * 8/2005 Perkins et al. ..... 211/94.01
6,926,376 B2 * 8/2005 Arent et al. ..... 312/194
6,991,199 B2 1/2006 Carpentier
2008/0016616 A1 1/2008 Roleder

* cited by examiner

RESTING DEVICE ASSEMBLY INCLUDING A TABLE AND A TROLLEY

RELATED APPLICATION

This application claims priority on U.S. Provisional Application Ser. No. 60/928,764 filed on May 11, 2007 and entitled "RESTING DEVICE ASSEMBLY INCLUDING A TABLE AND A TROLLEY". As far as is permitted, the contents of U.S. Provisional Application Ser. No. 60/928,764 are incorporated herein by reference.

BACKGROUND

As the benefits of therapeutic massage are becoming more widely appreciated, more and more people are participating in therapeutic massage. A typical massage table allows the patient to be resting while receiving a massage. Salon procedures such as manicures, pedicures and facial treatments have also become very popular for many people. A typical salon chair allows the patient to be relaxing in an inclined position while receiving a salon procedure. Important features for massage tables and salon chairs include high strength, support, stability, rigidity, and ease of usage. Additionally, whether a patient is receiving a massage or a salon procedure, the person performing the massage or salon procedure often utilizes one or more procedure related materials during the procedure.

SUMMARY

The present invention is directed to a resting device assembly for supporting a person above a surface during a procedure on the person. The resting device assembly includes a resting device and a trolley. In certain embodiments, the resting device includes a device top assembly having a padded device top that supports the person during the procedure. The trolley defines a storage area for storing procedure materials that are usable during the procedure. In some embodiments, the trolley is movable relative to the resting device between a storage position, wherein the trolley is positioned substantially beneath the resting device, and a working position, wherein the trolley is positioned next to the resting device. When the trolley is in the working position, the procedure materials are easily accessed from the trolley for use by the person performing the procedure.

In one embodiment, the trolley includes a trolley base that defines a storage area for storing the procedure materials, and a trolley top that is selectively movable relative to the trolley base between a retracted configuration and an expanded configuration. The trolley top includes a substantially flat trolley surface for supporting the procedure materials during the procedure. In one embodiment, the trolley further includes a top connector assembly that connects the trolley top to the trolley base and allows the trolley top to be selectively moved relative to the trolley base between the retracted configuration and the expanded configuration.

In one embodiment, when the trolley is in the storage position, it can be selectively attached to the resting device.

In certain embodiments, the resting device is movable between an inclined chair configuration and a substantially planar table configuration.

In some embodiments, the resting device includes a device frame that supports the device top assembly. In these embodiments, the device frame includes a frame base, a frame leg assembly having a plurality of spaced apart legs that support the frame base and the device top assembly above the surface, and a height adjuster that adjusts the length of the plurality of spaced apart legs so as to raise and lower the device top relative to the surface. In one embodiment, the frame base is a substantially rigid frame base that significantly increases the overall strength, support, and stability of the resting device assembly.

The present invention is also directed to a method for manufacturing a resting device assembly for supporting a person above a surface during a procedure.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Figure 1A:
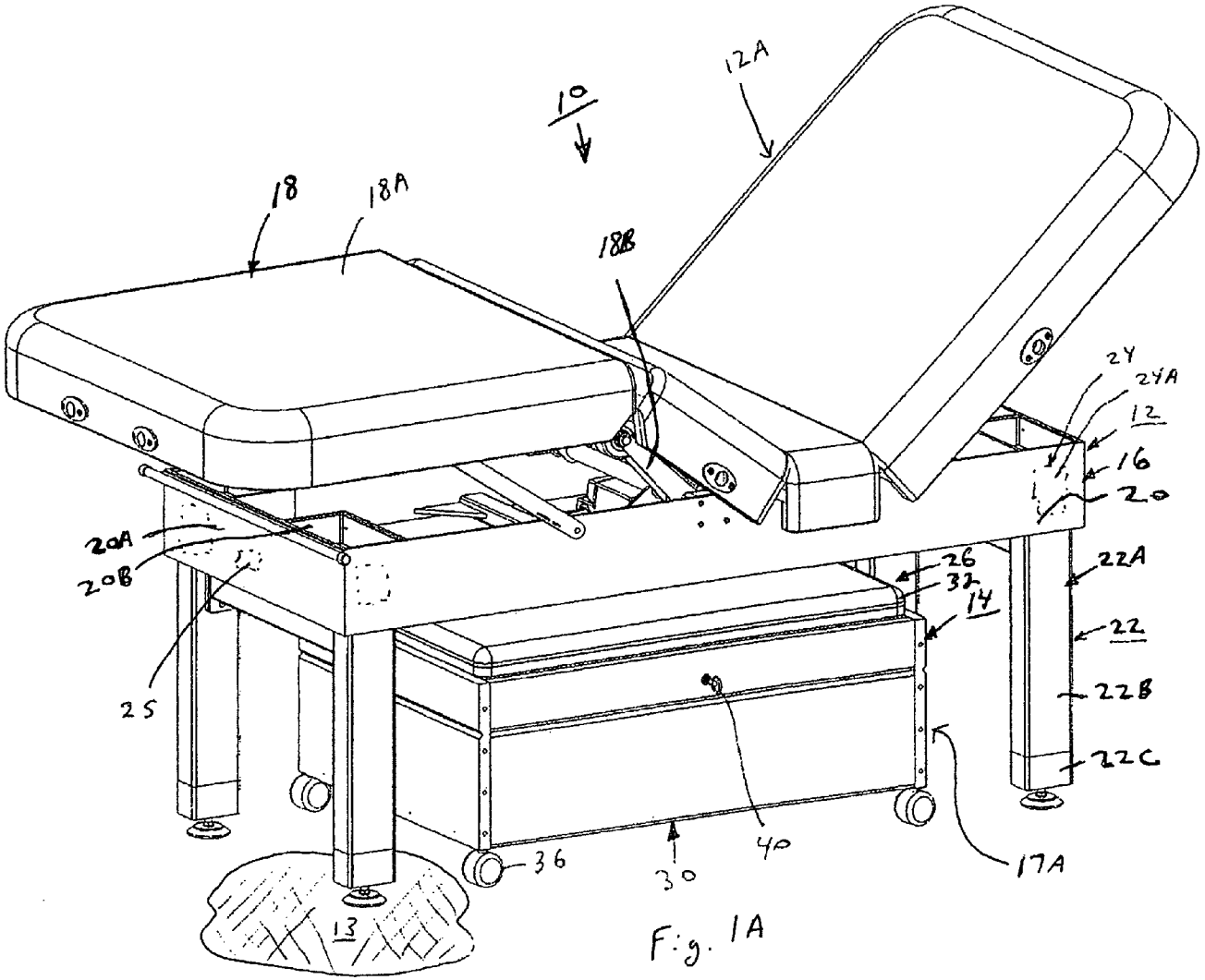
FIG. 1A is a perspective view of a first embodiment of a resting device assembly including a resting device and a trolley having features of the present invention, with the resting device positioned in an inclined chair configuration and the trolley in a retracted configuration positioned beneath the resting device.

FIGS. 1A, 1B and 2-4 illustrate perspective views of a resting device assembly 10 including a resting device 12 and a trolley 14 having features of the present invention. The size, shape, and functions of these components can be varied pursuant to the teachings provided herein.

As an overview, in certain embodiments, the resting device assembly 10 allows for improved support and movement of the resting device 12. In particular, the leg strength and stability of the resting device 12 is greatly increased by being independently supported by a rigid frame. Further, the trolley 14 provides a convenient location to store and position one or more procedure related materials 15 (illustrated as a box in FIGS. 3 and 4) for easy access and use during the procedure.

The resting device 12 supports a person above a surface 13 (illustrated in FIG. 1A) during a procedure, such as a salon procedure or a massage. The surface 13 can be a floor, the ground, or some other substantially level surface.

Figure 1B:
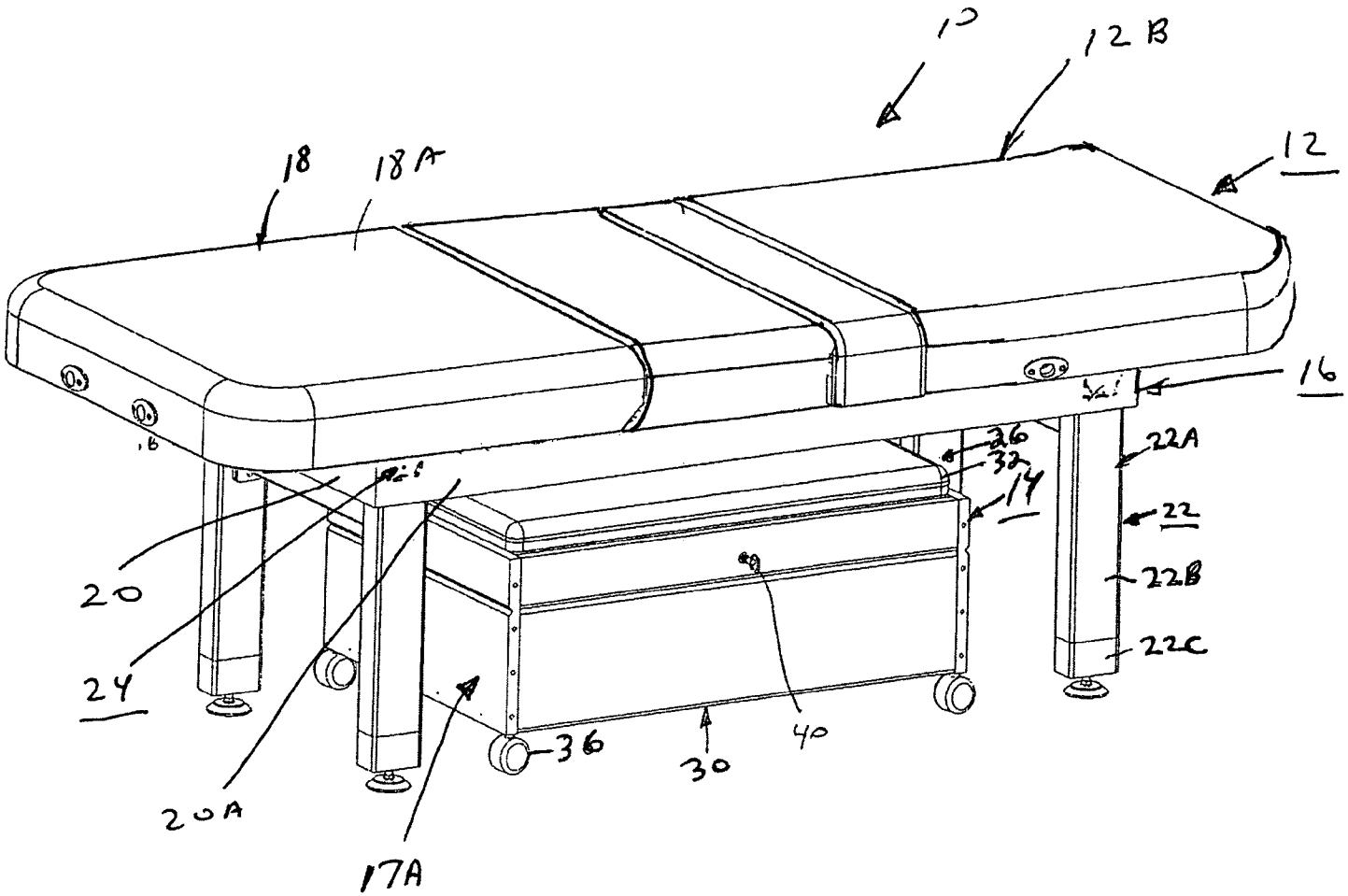
FIG. 1B is a perspective view of the resting device assembly of FIG. 1A, with the resting device positioned in a substantially planar table configuration and the trolley in the retracted configuration positioned beneath the resting device.

In some embodiments, the resting device 12 is convertible between an inclined salon chair configuration 12A, as illustrated in FIG. 1A, and a substantially planar massage table configuration 12B, as illustrated in FIG. 1B. During a salon procedure, the resting device 12 provides an inclined place for the person to sit while a procedure is being performed on that person. Procedures commonly performed in a salon are a manicure treatment on the fingernails of the person, a pedicure, facial treatments, a massage, and various other body treatments. During a massage procedure, the resting device 12 can be used to support a person in a generally flat or planar table configuration while a massage procedure is being performed on that person. An example of a suitable resting device 12 that is convertible between an inclined salon chair configuration 12A and a substantially planar massage table configuration 12B is described in U.S. Pat. No. 6,163,904, the contents of which are incorporated herein by reference. Alternatively, for example, the resting device 12 can have another design. For example, the resting device 12 can be a salon chair that is not movable to a flat massage table configuration, or the resting device 12 can be a massage table that is not movable to an inclined salon chair configuration.

In the embodiment illustrated in FIGS. 1A, 1B and 2-4, the resting device 12 includes a device frame 16 and a device top assembly 18.

The device frame 16 is rigid and supports the device top assembly 18 and some of the other components of the resting device 12. In one embodiment, the device frame 16 includes a frame base 20, a frame leg assembly 22, and a height adjuster 24 (illustrated in phantom). In FIGS. 1A, 1B and 2-4, the frame base 20 is generally rectangular frame shaped and includes four, generally flat plate shaped base sides 20A that form the rectangular frame base 20. Additionally, the frame base 20 can include four generally "L" shaped corner frame braces 20B that facilitate attachment of the frame leg assembly 22 to the frame base 20. In one embodiment, the frame base 20 is made of a rigid material such as steel, (e.g. steel plates).

In one embodiment, the device frame 16 is really stable and rigid, and functions as a unibody structure that supports the frame leg assembly 22 and the height adjuster 24. In this embodiment, the resting device 12 is able to provide significant support, stability and rigidity for the ease and comfort of the person receiving the procedure and for the person administering the procedure.

The frame leg assembly 22 supports the frame base 20 and the device top assembly 18 above the surface 13. Further, in certain embodiments, the frame leg assembly 22 allows for height adjustment of the device top assembly 18 relative to the surface 13. The design of the frame leg assembly 22 can vary. In FIGS. 1A, 1B and 2-4, the frame leg assembly 22 includes four spaced apart legs 22A, with each of the legs 22A being positioned at one of the corners of the frame base 20. In one embodiment, each of the legs 22A is telescoping and includes an upper leg section 22B that is fixedly secured to the rigid frame base 20, and a lower leg section 22C that partly fits within the upper leg section 22B. The lower leg section 22C is designed to move relative to the upper leg section 22B to adjust the length of the leg 22A and, correspondingly, adjust the height of the device top assembly 18 relative to the surface 13. In the Figures, each of the leg sections 22B, 22C is generally rectangular tube shaped. For example, each of the leg sections 22B, 22C can have relatively tight tolerances with the lower leg section 22C fitting within and sliding within the upper leg section 22B.

The height adjuster 24 moves the upper leg sections 22B relative to the lower leg sections 22C to adjust the height of the device top assembly 18 relative to the surface 13. In one embodiment, the height adjuster 24 includes four electrical, actuators 24A. For example, the height adjuster 24 can include four linear motors. Each of the actuators 24A is designed to electronically move one of the upper leg sections 22B relative to its respective lower leg section 22C. With this design, the actuators 24A can be controlled to precisely adjust the length of the legs 22A and, correspondingly, the height of the device top assembly 18 relative to the surface 13.

In one non-exclusive embodiment, each actuator 24A is a ball screw type motor, in which the motor rotates a ball screw to selectively move the lower leg section 22C relative to the upper leg section 22B. In this embodiment, a single control system 25 (illustrated as a box in phantom in FIG. 1A) can direct power to each of the actuators 24A to control the operation of the actuators 24A. With this design, the control system 25 (under the control of the operator of the device) can control the actuators 24A to adjust the height of the legs simultaneously.

The device top assembly 18 supports the person above the surface 13 during the salon procedure or massage. The design of the device top assembly 18 can vary. In the embodiment shown in FIGS. 1A, 1B and 2-4, the device top assembly 18 includes a padded device top 18A having four, padded top sections that are movable relative to the frame base 20 and pivotable relative to each other to orientate the device top assembly 18 in an inclined chair configuration 12A for seating of the person during a manicure or another salon procedure, or a generally planar table configuration 12B for supporting the person during a massage. Alternatively, the device top assembly 18 could be designed with greater or fewer than four top sections, or the device top assembly 18 can be designed to be moved to greater than two configurations.

Additionally, the device top assembly 18 can include a top mover assembly 18B that moves the four top sections of the padded device top 18A between the configurations 12A, 12B. The design of the top mover assembly 18B can vary. In one embodiment, the top mover assembly 18B can include one or more electrical motors and/or linkages to move the four top sections of the padded device top 18A. Alternatively, the four top sections of the padded device top 18A can be moved manually and/or the resting device 12 can be designed so that the top sections of the padded device top 18A do not move relative to each other.

Further, the resting device 12 can include an armrest assembly (not shown) having a left armrest for supporting the left arm of the person during the manicure treatment on the left hand, and a right armrest for supporting the right arm of the person during the manicure treatment on the right hand.

The trolley 14 provides a convenient location to store and position one or more procedure related materials 15 for use during the procedure. For example, the trolley 14 can store and position one or more lubricants, chemicals, towels, facial treatment tools, and hot and cool therapy devices used in the massage or salon procedure.

The design of the trolley 14 can vary. In some embodiments, the trolley 14 is movable relative to the resting device 12 between a storage position 17A (illustrated in FIGS. 1A and 1B), wherein the trolley 14 is positioned substantially beneath the resting device 12, and a working position 17B (illustrated in FIGS. 2-4), wherein the trolley 14 is positioned next to and spaced apart from the resting device 12 so that the procedure related materials 15 are easily accessed from the trolley 14.

Figure 2:
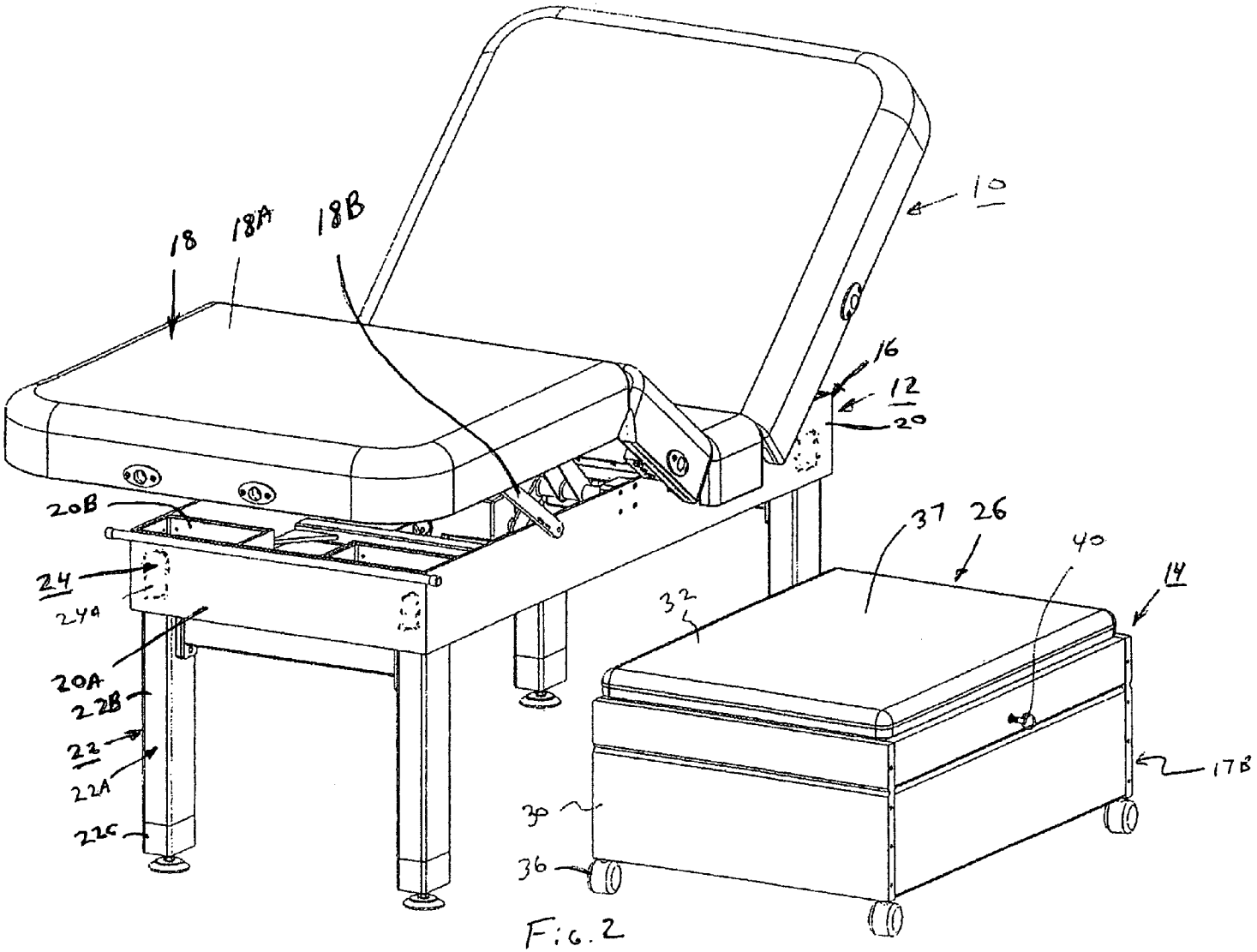
FIG. 2 is another perspective view of the resting device assembly of FIG. 1A, with the trolley in the retracted configuration positioned next to the resting device.
Figure 3:
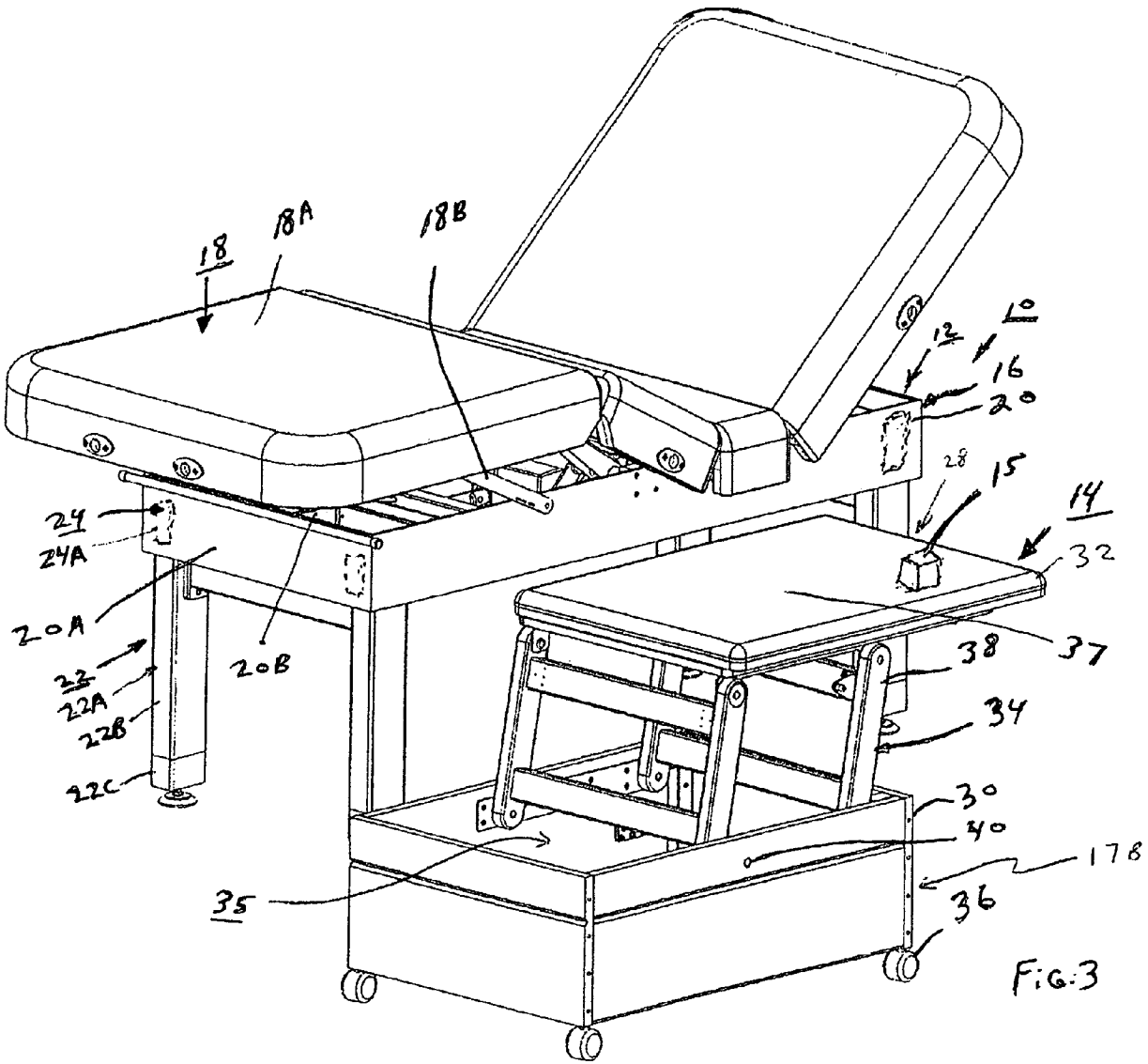
FIG. 3 is still another perspective view of the resting device assembly of FIG. 1A, with the trolley in an expanded configuration positioned next to the resting device.
Figure 4:
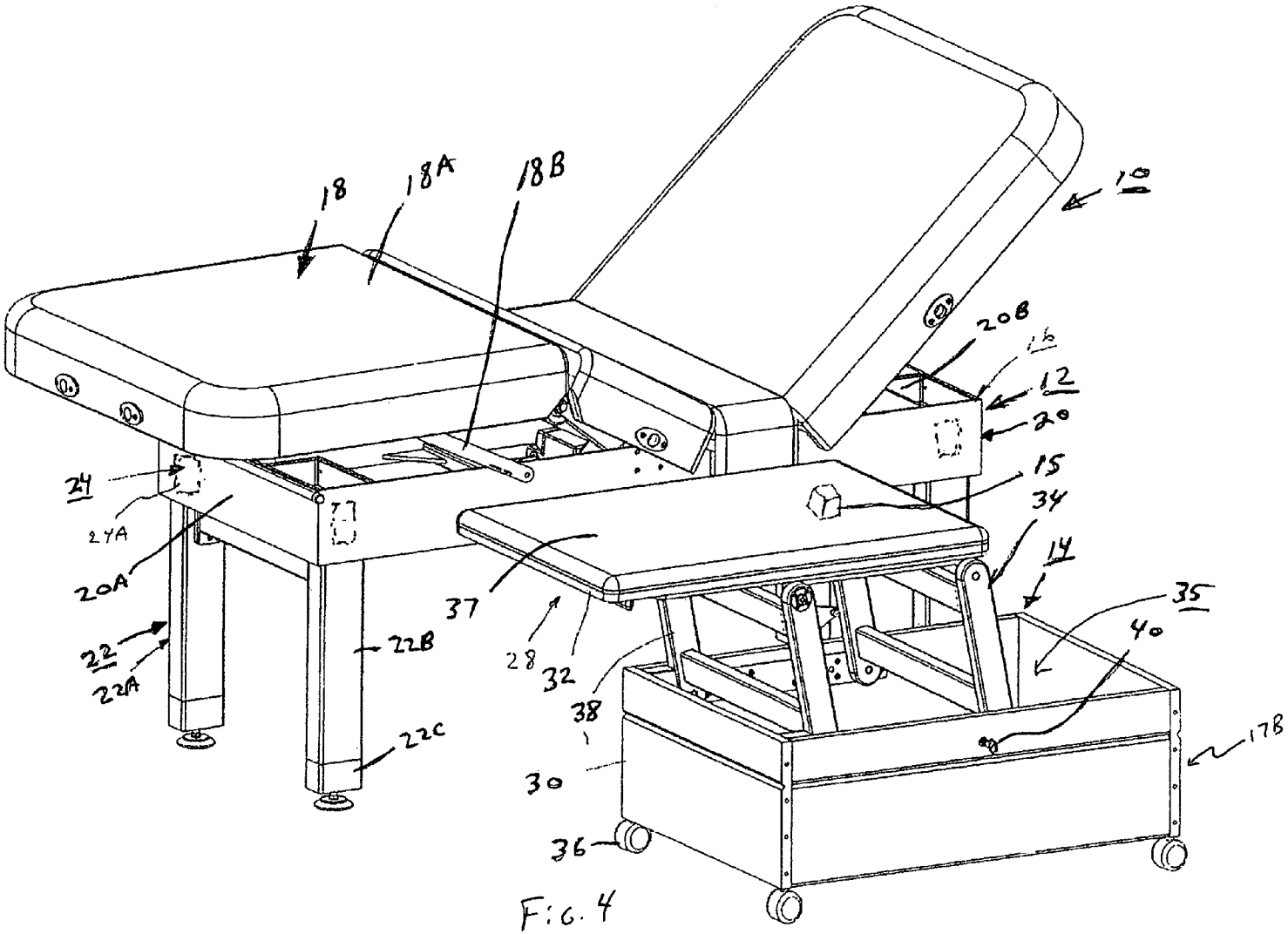
FIG. 4 is yet another perspective view of the resting device assembly of FIG. 1A, with the trolley in the expanded configuration positioned next to the resting device.

In one embodiment, the trolley 14 is movable between a retracted configuration 26, as illustrated in FIGS. 1A, 1B and 2, and an expanded configuration 28, as illustrated in FIGS. 3 and 4. In the retracted configuration 26, the trolley 14 stores the procedure related materials 15 and in the expanded configuration 28 the trolley 14 maintains the procedure related materials 15 near the resting device 12 for easy access by the user. Further, in the certain embodiments, in the retracted configuration 26, the trolley 14 is sized and shaped to fit under the resting device 12 so that it is out of the way for storage.

When the trolley 14 is in the retracted configuration 26 it can be moved easily between the storage position 17A and the working position 17B. In certain embodiments, the trolley 14 is sized and shaped so that it can only be moved into the expanded configuration 28 when the trolley 14 is in the working position 17B or is otherwise positioned away from the storage position 17A.

As illustrated in FIGS. 1A, 1B and 2-4, the trolley 14 includes a trolley base 30, a trolley top 32, and a top connector assembly 34. The size, shape and configuration of these components can be varied.

In one embodiment, the trolley base 30 is generally shaped like an open, rectangular box. With this design, the trolley base 30 defines a storage area 35 (illustrated in FIGS. 3 and 4) for storing the procedure related materials 15 when the trolley 14 is not being used during a procedure. Additionally or alternatively, for example, a hot towel warmer can be installed in the trolley 14.

The trolley base 30 can include a plurality of wheels 36 that allow the trolley 14 to be moved relative to the resting device 12. For example, the trolley base 30 can include four spaced apart wheels 36 that allow the trolley 14 to be selectively and freely moved under, away from, and around the resting device 12.

The trolley top 32 provides a substantially flat trolley surface 37 for supporting the procedure related materials 15 during the procedure. With this design the user can easily access the procedure related materials 15 during the administration of a procedure. In one embodiment, the trolley top 32 is generally rectangular shaped.

Further, in certain embodiments, the trolley top 32 is selectively movable relative to the trolley base 30 between the retracted configuration 26 and the expanded configuration 28.

The top connector assembly 34 connects the trolley top 32 to the trolley base 30 and allows the trolley top 32 to be selectively moved relative to the trolley base 30 between the retracted configuration 26 and the expanded configuration 28. The design of the top connector assembly 34 can be varied to achieve the movement described herein. In the Figures, the top connector assembly 34 includes a pair of spaced apart connectors 38 that connect the trolley top 32 to the trolley base 30. In this embodiment, the connectors 38 cooperate with the trolley top 32 and the trolley base 30 to define a four bar type linkage that (i) allows the trolley top 32 to pivot and move upward during movement from the retracted configuration 26 to the expanded configuration 28, and (ii) allows the trolley top 32 to pivot and move downward during movement from the expanded configuration 28 to the retracted configuration 26. Alternatively, the trolley top 32 can be moved up and down in another fashion.

In one embodiment, the trolley top 32 is biased, e.g. by a spring, toward the expanded configuration 28 and held in position in the retracted configuration 26 with a latch 40. With this design, when the latch 40 is released, the trolley top 32 moves upward from the retracted configuration 26 to the expanded configuration 28 and is held in position in the expanded configuration 28. Further, the trolley top 32 can be manually urged downward to the retracted configuration 26 and maintained in the retracted configuration 26 with the latch 40.

Alternatively, for example, a motor can be used to electrically move the trolley top 32 between the retracted configuration 26 and the expanded configuration 28.

Figure 5:
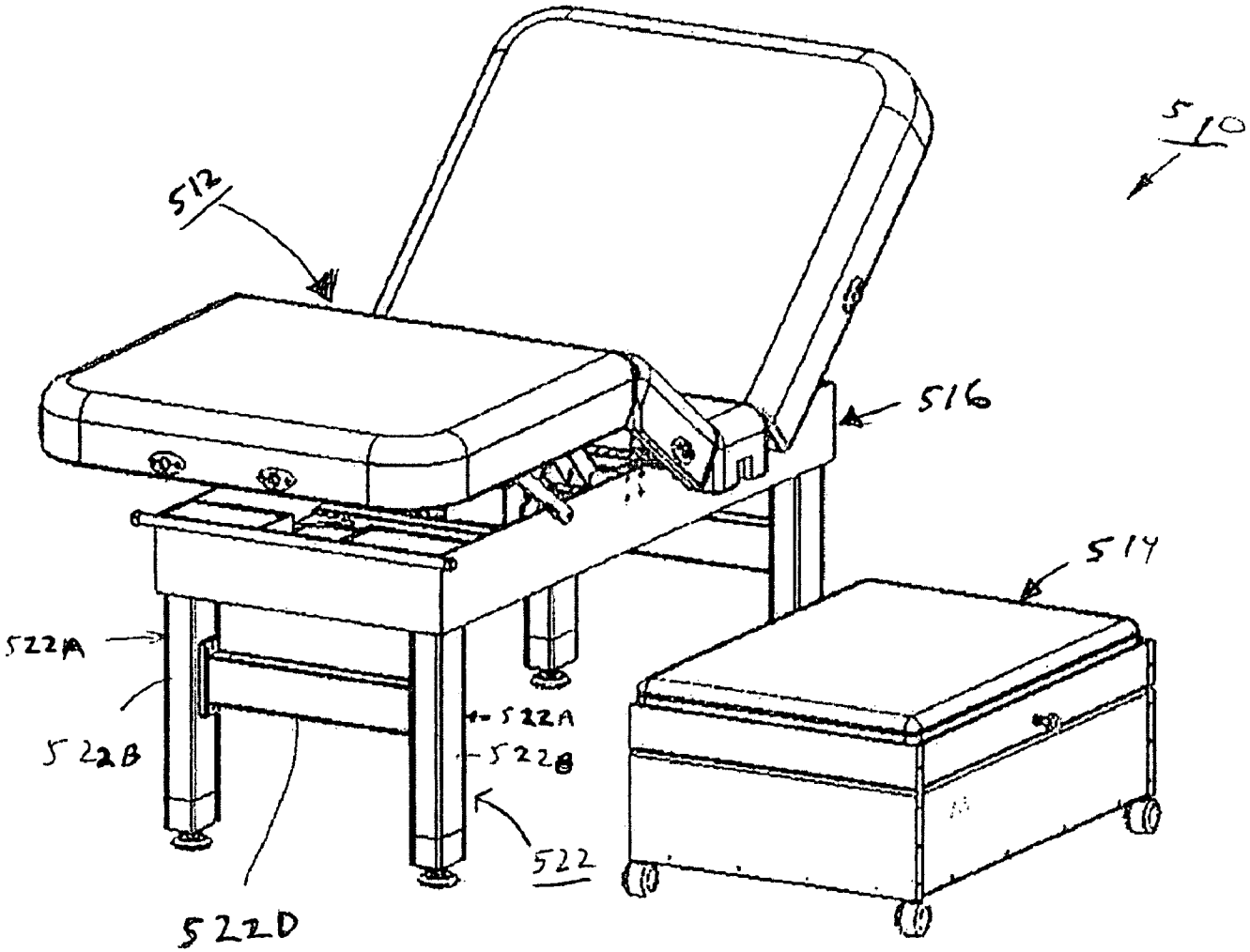
FIG. 5 is a perspective of a second embodiment of a resting device assembly including a resting device and a trolley having features of the present invention.

FIG. 5 is a perspective view of another embodiment of a resting device assembly 510 having features of the present invention. The resting device assembly includes a resting device 512 and a trolley 514. The design features and capabilities of the trolley 514 illustrated in FIG. 5 are substantially similar to the design features and capabilities of the trolley 14 illustrated in FIGS. 1A, 1B and 2-4, so they will not be further described herein. The design features and capabilities of the resting device 512 illustrated in FIG. 5 are substantially similar to the design features and capabilities of the resting device 14 illustrated in FIGS. 1A, 1B and 2-4, except that in this embodiment, the frame leg assembly 522 includes a pair of rigid leg braces 522D, with each leg brace 522D extending between and securing the upper leg section 522B of two of the legs 522A together. The leg braces 522D add a significant amount of support and stability to the legs 522A. With this design, the use of the rigid device frame 516 and the leg braces 522D allow the area below the device frame 516 and between the legs 522A to be completely open for receiving the trolley 514 or another device.

Figure 6:
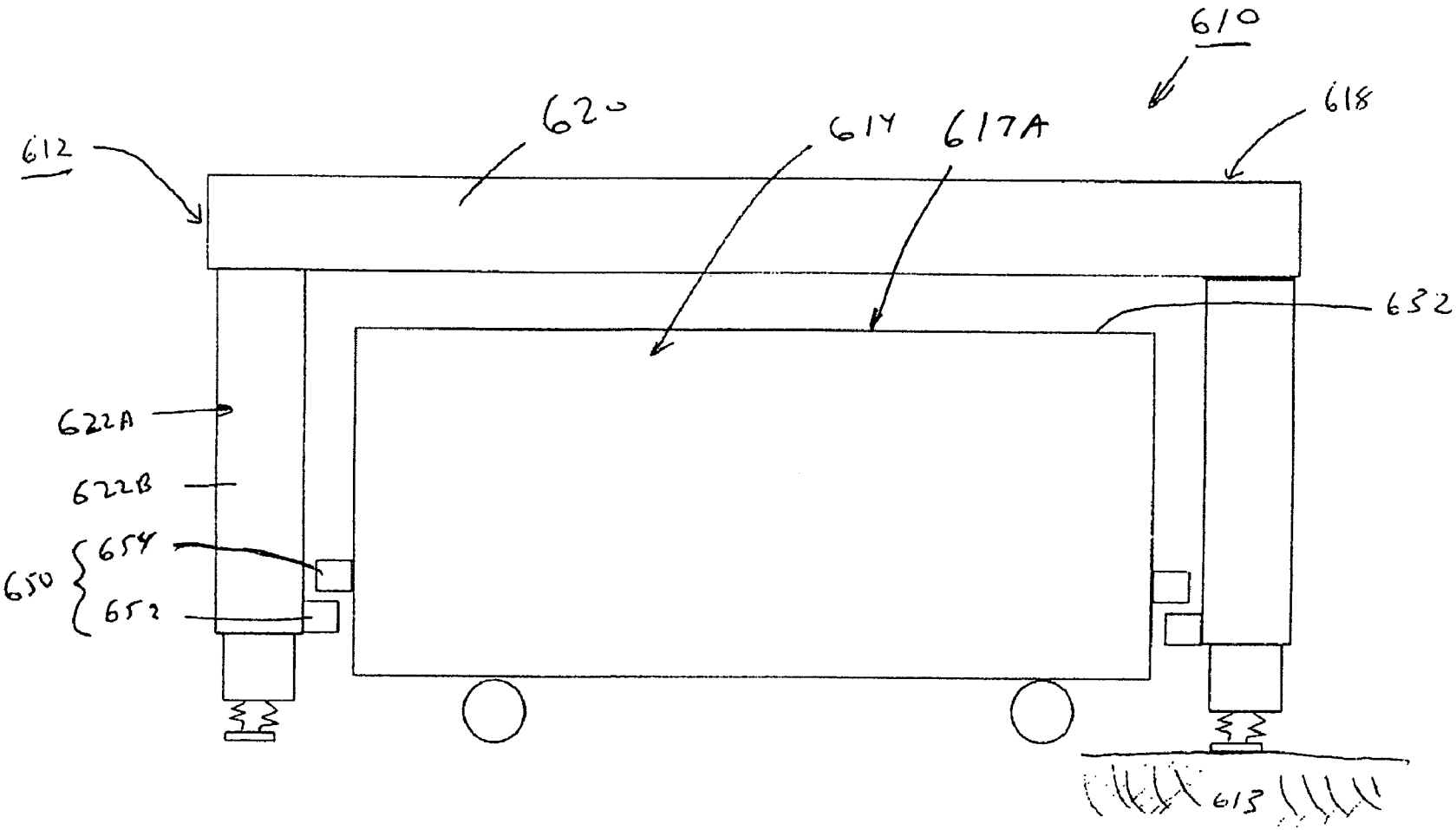
FIG. 6 is a simplified side view of a portion of a third embodiment of a resting device assembly including a resting device and a trolley having features of the present invention.

FIG. 6 is a simplified side view of a portion of another embodiment of a resting device assembly 610 having features of the present invention. In FIG. 6, the device top assembly 618, the frame base 620 and the legs 622A of the resting device 612, and the trolley 614 are illustrated. In this embodiment, when the trolley 614 is in its storage position 617A (in its retracted configuration and positioned under the frame base 620) it can be selectively attached to the resting device 612 so that the trolley 614 can travel up and down concurrently as the device top assembly 618 is raised and lowered relative to the surface 613. Many ways of connecting the trolley 614 to the resting device 612 are possible. In FIG. 6, the connecting device 650 includes a leg rail 652 that is secured to the upper leg section 622B of each of the legs 622A and a corresponding pair of trolley rails 654 that are secured to opposite sides of the trolley 614. In this embodiment, when the upper leg sections 622B are moved upward, the leg rails 652 engage the trolley rails 654 so that the trolley 614 moves upward with the device top assembly 618. Further, in one embodiment, when the device top assembly 618 is completely lowered, the trolley 614 can be easily removed from under the resting device 612.

This feature is unique in that when the trolley 614 is in the retracted position under the resting device 612, the trolley 614 feature is hidden and the resting device 612 appears as a normal massage table or salon chair with a fixedly secured under cabinet.

Additionally, the trolley 614 can have a folding work light embedded in the trolley top 632. This work light can be similar to an old style accordion desk lamp or as simple as a goose neck lamp that folds into the trolley 614 for storage. The work light will be attached to the moving trolley 614, and the light will be used for assisting in therapy treatments such as facials and various skin treatments.

While the current invention is disclosed in detail herein, it is to be understood that it is merely illustrative of the presently preferred embodiments of the invention and that no limitations are intended to the details of construction or design herein shown.

What is claimed is:

1. A resting device assembly for supporting a person above a surface during a procedure on the person, the resting device assembly comprising:

a resting device including a device top assembly having a padded device top that supports the person during the procedure; and a trolley that is movable relative to the resting device between a storage position and a working position, the trolley including a trolley base that defines the storage area for storing procedure materials, and a trolley top that is selectively movable relative to the trolley base between a retracted configuration and an expanded configuration, wherein when the trolley top is in the retracted configuration the trolley top is substantially horizontal so that the trolley fits under the resting device in the storage position, and wherein when the trolley top is in the expanded configuration the trolley top is substantially horizontal for supporting the procedure materials during the procedure.

2. The resting device assembly of claim 1 wherein the trolley top is biased toward the expanded configuration, and wherein the trolley further includes a latch that holds the trolley top in the retracted configuration.

3. The resting device assembly of claim 1 wherein the trolley further includes a motor that moves the trolley top between the retracted configuration and the expanded configuration.

4. The resting device assembly of claim 1 wherein the trolley further includes a top connector assembly that connects the trolley top to the trolley base, the top connector assembly including a pair of spaced apart connectors that cooperate with the trolley top and the trolley base to define a four bar type linkage that allows the trolley top to be selectively moved relative to the trolley base between the retracted configuration and the expanded configuration.

5. The resting device assembly of claim 1 wherein the storage position includes the trolley being positioned substantially beneath the resting device, and wherein the working position includes the trolley being positioned next to and spaced apart from the resting device so that the procedure materials are easily accessed from the trolley.

6. The resting device assembly of claim 1 wherein when the trolley is in the storage position it is selectively attached to the resting device.

7. The resting device assembly of claim 1 wherein the resting device is movable between an inclined chair configuration and a substantially planar table configuration.

8. The resting device assembly of claim 1 wherein the resting device further includes a device frame that supports the device top assembly, the device frame including a frame base, a frame leg assembly having a plurality of spaced apart legs that supports the frame base and the device top assembly above the surface, and a height adjuster that adjusts the length of the plurality of spaced apart legs so as to raise and lower the device top relative to the surface.

9. The resting device assembly of claim 8 wherein the height adjuster includes a plurality of actuators, wherein each actuator electronically adjusts the length of one of the plurality of spaced apart legs to selectively raise and lower the device top relative to the surface.

10. The resting device assembly of claim 9 wherein each of the plurality of legs includes an upper leg section that is fixedly secured to the frame base and a lower leg section, and wherein each actuator moves one of the upper leg sections relative to its respective lower leg section to adjust the height of the device top relative to the surface.

11. A resting device assembly for supporting a person above a surface during a procedure on the person, the resting device assembly comprising:

a resting device including a device top assembly having a padded device top that supports the person during the procedure; and a trolley that is movable relative to the resting device between a storage position and a working position, the trolley including a trolley base that defines the storage area for storing procedure materials, a trolley top, and a top connector assembly that connects the trolley top to the trolley base, the top connector assembly including a pair of spaced apart connectors that cooperate with the trolley top and the trolley base to define a four bar type linkage that allows the trolley top to be selectively moved relative to the trolley base between a retracted configuration and an expanded configuration.

12. The resting device assembly of claim 11 wherein the trolley top is biased toward the expanded configuration, and wherein the trolley further includes a latch that holds the trolley top in the retracted configuration.

13. The resting device assembly of claim 11 wherein the trolley further includes a motor that moves the trolley top between the retracted configuration and the expanded configuration.

14. The resting device assembly of claim 11 wherein the storage position includes the trolley being positioned substantially beneath the resting device, and wherein the working position includes the trolley being positioned next to and spaced apart from the resting device so that the procedure materials are easily accessed from the trolley.

15. The resting device assembly of claim 11 wherein when the trolley is in the storage position it is selectively attached to the resting device.

16. The resting device assembly of claim 11 wherein the resting device is movable between an inclined chair configuration and a substantially planar table configuration.

17. The resting device assembly of claim 11 wherein the resting device further includes a device frame that supports the device top assembly, the device frame including a frame base, a frame leg assembly having a plurality of spaced apart legs that supports the frame base and the device top assembly above the surface, and a height adjuster that adjusts the length of the plurality of spaced apart legs so as to raise and lower the device top relative to the surface.

18. The resting device assembly of claim 17 wherein the height adjuster includes a plurality of actuators, wherein each actuator electronically adjusts the length of one of the plurality of spaced apart legs to selectively raise and lower the device top relative to the surface.

19. The resting device assembly of claim 18 wherein each of the plurality of legs includes an upper leg section that is fixedly secured to the frame base and a lower leg section, and wherein each actuator moves one of the upper leg sections relative to its respective lower leg section to adjust the height of the device top relative to the surface.

20. A resting device assembly for supporting a person above a surface during a procedure on the person, the resting device assembly comprising:

a resting device including a device top assembly having a padded device top that supports the person during the procedure, and a device frame that supports the device top assembly, the device frame including a frame base, a frame leg assembly having a plurality of spaced apart legs that supports the frame base and the device top assembly above the surface, and a height adjuster that adjusts the length of the plurality of spaced apart legs so as to raise and lower the device top relative to the surface; and a trolley that is movable relative to the resting device between a storage position wherein the trolley is positioned substantially beneath the resting device, and a working position wherein trolley is positioned next to and spaced apart from the resting device so that procedure materials are easily accessed from the trolley, the trolley including a trolley base that defines the storage area for storing the procedure materials, a trolley top, and a top connector assembly that connects the trolley top to the trolley base, the top connector assembly including a pair of spaced apart connectors that cooperate with the trolley top and the trolley base to define a four bar type linkage that allows the trolley top to be selectively moved relative to the trolley base between a retracted configuration and an expanded configuration, wherein when the trolley top is in the retracted configuration the trolley top is substantially horizontal so that the trolley fits under the resting device in the storage position, and wherein when the trolley top is in the expanded configuration the trolley top is substantially horizontal for supporting the procedure materials during the procedure.

21. The resting device assembly of claim 20 wherein each of the plurality of legs includes an upper leg section that is fixedly secured to the frame base and a lower leg section, the upper leg section moving relative to the lower leg section to adjust the height of the device top relative to the surface.

22. The resting device assembly of claim 20 wherein when the trolley is in the storage position it is selectively attached to the resting device so that the trolley travels up and down concurrently as the height of the device top is adjusted relative to the surface.

* * * * *